US008459712B2

(12) United States Patent
Thrasher et al.

(10) Patent No.: US 8,459,712 B2
(45) Date of Patent: Jun. 11, 2013

(54) APPARATUS FOR COUPLING AND DECOUPLING CLIPS

(75) Inventors: Charles T Thrasher, Dallas, GA (US); Jeffrey M. Kornreich, Woodstock, GA (US); Brian Fraser, Atlanta, GA (US)

(73) Assignee: Home Depot USA, Inc., Atlanta, GA (US)

( * ) Notice: Subject to any disclaimer, the term of this patent is extended or adjusted under 35 U.S.C. 154(b) by 222 days.

(21) Appl. No.: 12/398,399

(22) Filed: Mar. 5, 2009

(65) Prior Publication Data

US 2010/0225130 A1 Sep. 9, 2010

(51) Int. Cl.
*B66F 19/00* (2006.01)

(52) U.S. Cl.
USPC ..... 294/209; 294/24; 248/219.2

(58) Field of Classification Search
USPC ..... 294/19.1, 22, 23, 24, 92, 17, 174; 7/128, 7/138, 139; 269/3, 6, 241; 81/53.1; 24/370, 24/373; 403/96–98; 248/121, 218.4, 219.2, 248/316.7
See application file for complete search history.

(56) References Cited

U.S. PATENT DOCUMENTS

| | | | | |
|---|---|---|---|---|
| 6,425,614 | B1 * | 7/2002 | Limber et al. | 294/24 |
| 6,474,197 | B1 * | 11/2002 | Browen et al. | 81/3.8 |
| 6,572,062 | B1 * | 6/2003 | Limber et al. | 248/227.1 |
| 6,659,521 | B2 * | 12/2003 | Hill et al. | 294/19.1 |
| 6,827,379 | B2 * | 12/2004 | Hill et al. | 294/19.1 |
| 6,877,400 | B2 * | 4/2005 | Weaver et al. | 81/53.1 |
| 6,925,676 | B2 * | 8/2005 | Heavner et al. | 15/236.04 |
| 6,943,301 | B2 * | 9/2005 | Lee | 174/138 R |
| 6,964,407 | B1 * | 11/2005 | Butler | 254/131 |
| 7,429,067 | B1 * | 9/2008 | Rosa | 294/19.1 |

* cited by examiner

*Primary Examiner* — Dean Kramer
*Assistant Examiner* — Stephen Vu
(74) *Attorney, Agent, or Firm* — Fulbright & Jaworski L.L.P.

(57) ABSTRACT

An apparatus for coupling and decoupling clips is described. Specifically, the apparatus allows for installation of clips to building structures of varying elevations. The apparatus may comprise a telescoping pole, a lower pivot joint, an upper pivot joint, and at least one reversible clip. The reversible clip may be removed from the upper pivot joint by applying a substantially vertical force in a downward direction to the telescoping pole. Lights may be attached to the reversible clip. The lower pivot joint and upper pivot joint allow for the reversible clip to be coupled to building structures at various angles.

3 Claims, 14 Drawing Sheets

APPARATUS FOR COUPLING AND DECOUPLING CLIPS

FIELD OF THE INVENTION

The present invention generally relates to an apparatus for mounting or attaching clips. More particularly, the clips may be coupled to a building structure and used for hanging holiday lights.

BACKGROUND OF THE INVENTION

Strings of decorative lights are commonly hung from buildings, dwellings, and other architectural structures during festive occasions such as the annual holidays in late December. The strings of decorative lights may be comprised of evenly spaced light bulbs having a single color or a plurality of colors. The lights are typically hung on the exterior of a building along the upper perimeter. For example, strings of decorative lights may be hung to outline the roofline of a house.

Strings of decorative lights are typically hung by fastening nails or screws to a surface of a building. A ladder is often used to fasten each nail or screw if the hanging position is a substantial distance from ground level. The lights are then mounted to the nails or screws.

SUMMARY OF THE INVENTION

An apparatus is provided for coupling clips to a plurality of building structures. The apparatus may comprise: a telescoping pole having a first end and a second end; a lower pivot joint having a first end and a second end, wherein the first end of the lower pivot joint is coupled to the first end of the telescoping pole; an upper pivot joint having a first end and a second end, wherein the first end of the upper pivot joint is coupled to the second end of the lower pivot joint, wherein an angle formed by the first end of the upper pivot joint and the second end of the lower pivot joint is adjustable; a clip removably coupled to the second end of the upper pivot joint. The clip may be decoupled from the second end of the upper pivot joint without rotation.

The clip may comprise: a base having a first end and a second end; a first clasp coupled to the first end of the base; a second clasp coupled to the second end of the base, wherein an exterior surface of the first clasp and an exterior surface of the second, clasp define a third clasp. The clip may be coupled to a building structure.

The method for coupling a reversible clip to a building structure or an element of the building structure may comprise adjusting the length of a telescoping pole; coupling the reversible clip to the telescoping pole; and applying a substantially vertical force to the telescoping pole to couple the reversible clip to the building element. The clip may be decoupled from the telescoping pole without rotation of the telescoping pole.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present disclosure, as defined solely by the claims, will become apparent in the non-limiting detailed description set forth below.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components, and circuits have not been described in detail so as not to obscure the present invention.

Figure 1:
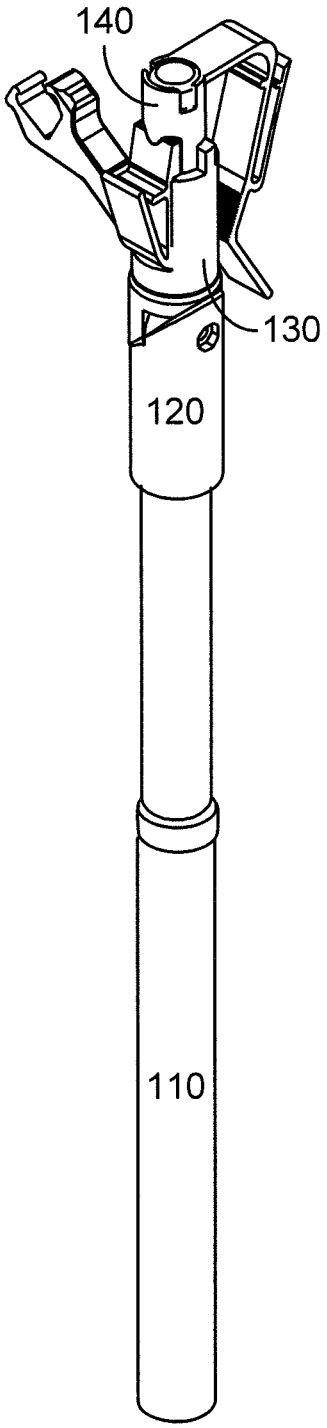
FIG. 1 is a perspective view of a light mounting apparatus.

FIG. 1 depicts an embodiment of a light mounting apparatus. The light mounting apparatus comprises a telescoping pole 110, a lower pivot joint 120, an upper pivot joint 130, and a reversible clip 140. The lower pivot joint 120 is coupled to the telescoping pole 110 and the upper pivot joint 130. The upper pivot joint 130 is also coupled to the reversible clip 140. The lower pivot joint 120 will be described in greater detail below and in FIG. 2; the upper pivot joint 130 will be described in greater detail below and in FIGS. 3A and 3B; the reversible clip 140 will be described in greater detail below and in FIGS. 4A and 4B.

The telescoping pole 110 may have a first end and a second end. The first end or the second end of the telescoping pole 110 may have a handle. The telescoping pole 110 may have an adjustable length of between approximately two feet (0.6 meters) and 24 feet (7.3 meters). The minimum length of the telescoping pole 110 may be defined by fully compressing the telescoping pole 110. The maximum length of the telescoping pole 110 may be defined by fully extending the telescoping pole 110. The telescoping pole 110 may allow a user of the light mounting apparatus to couple the reversible clip 140 to building elements of varying heights without the use of a ladder. Decorative lights and other festive ornaments may be coupled to a plurality of reversible clips.

Figure 2:
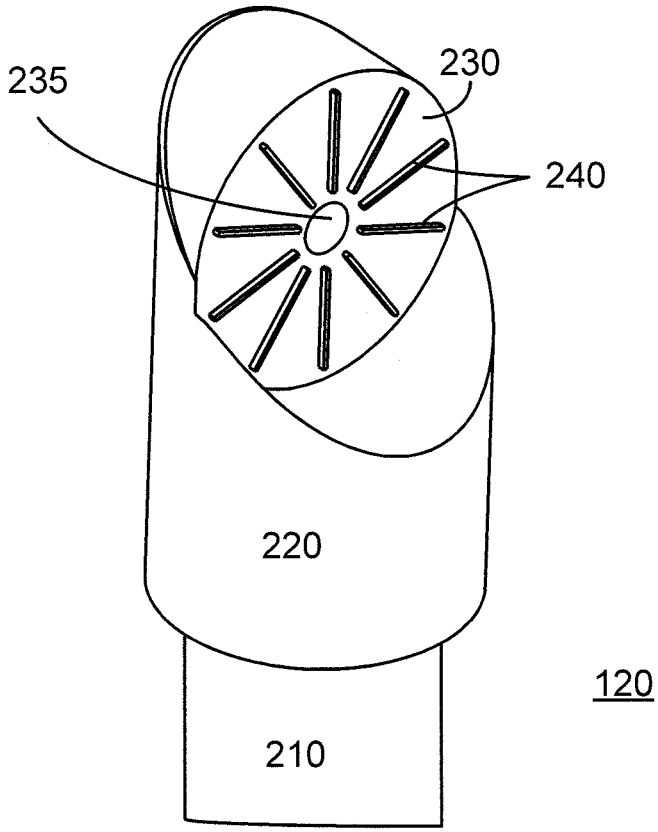
FIG. 2 is a perspective view of a lower pivot joint.

FIG. 2 depicts an embodiment of the lower pivot joint 120. The lower pivot joint 120 may have a first end and a second end. The lower pivot joint 120 comprises a stem 210, a body 220, and an appendage 230. The body 220 may be coupled to the stem 210 and the appendage 230. The stem 210 may define the first end and the appendage 230 may define the second end, or vise versa.

The stem 210 may have a cylindrical shape with a length of approximately two centimeters and a diameter of approximately 1.5 centimeters. The body 220 may have a cylindrical shape having a diameter of approximately 2.3 centimeters. Appendage 230 may have a length of approximately 2.0 centimeters. The face of the appendage 230 may comprise a plurality of elevated grooves 240. Further, the appendage 230 may define at least a single through hole 235. For one embodiment of the invention, the appendage 230 comprises ten (10) grooves 240. Each groove may be positioned between the through hole 235 and the outside surface of the face of the appendage 230.

The stem 210 of the lower pivot joint 120 may be coupled to the first end of the telescoping pole 110. For example, the stem may be compression fitted into an opening of the first end of the telescoping pole 110, and/or secured with an adhesive or a tape. For another embodiment of the invention, the lower pivot joint 120 may be part of the telescoping pole 110 such that the telescoping pole 110 comprises a stem 210, a body 220, and an appendage 230.

Figure 3A:
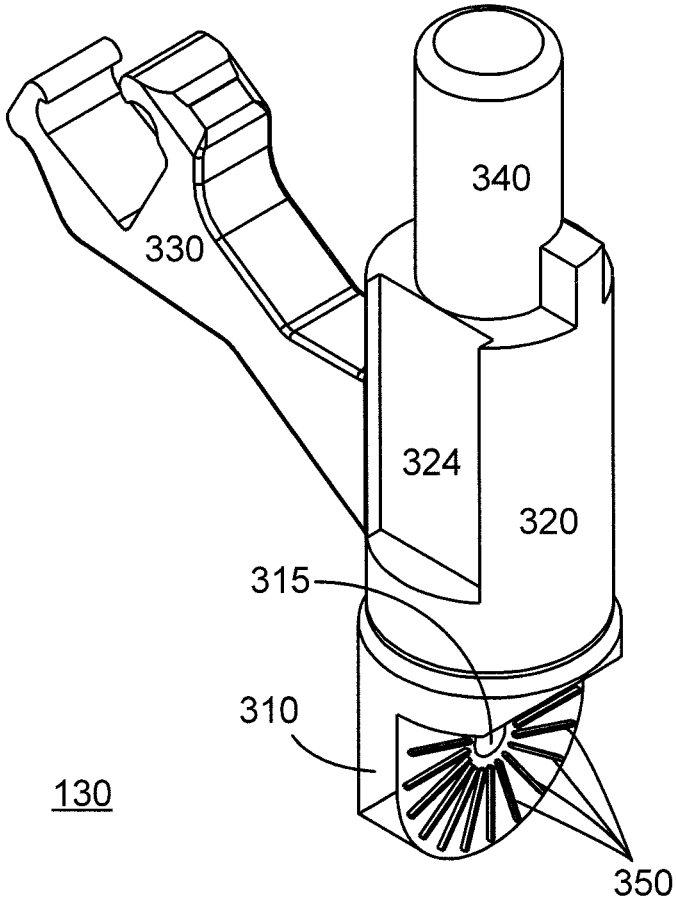
FIG. 3A is a first perspective view of an upper pivot joint.

The appendage 230 of the lower pivot joint 120 may be coupled to the upper pivot joint 130. The upper pivot joint 130 may have a first end and a second end. The upper pivot joint 130 comprises an appendage 310, a body 320, a claw 330, and a neck 340. The body 320 is coupled to the appendage 310, the claw 330, and the neck 340. The appendage 310 may define the first end and the neck 340 may define the second end, or vise versa. FIG. 3A depicts a first perspective view of one embodiment of the upper pivot joint 130.

The face of the appendage 310 may comprise a plurality of elevated grooves 350. The appendage 310 may define at least a single through hole 315. For one embodiment of the invention, the appendage 310 comprises twenty (20) grooves. Each groove is positioned between the through hole 315 and the outside surface of the face of the appendage 310.

The upper pivot joint 130 may be coupled to the lower pivot joint 120 by placing the face of the appendage 310 in contact with the face of the appendage 230. The angle formed between the upper pivot joint 130 and the lower pivot joint 120 may be adjusted by rotating the upper pivot joint grooves 350 about the lower pivot joint grooves 240. When the desired angle is set, a fastening mechanism may secure the upper pivot joint 130 to the lower pivot joint 120. For example, a bolt may be inserted through through holes 235 and 315 and secured with a wing nut.

The body 320 of the upper pivot joint 130 may have a substantially cylindrical shape. The length of the body 320 may be approximately 3.7 centimeters as measured between the appendage 310 and the neck 340. Body 320 may define a notch 324. The notch 324 may allow the upper pivot joint 130 to couple to the reversible clip 140 when the reversible clip 140 is in a downward position. This coupling will be discussed in greater detail below. The notch 324 may be oriented 90 degrees to the left with respect to the face of the appendage 310.

The claw 330 may comprise at least an upward directed hook. In addition, the claw may comprise a downward directed hook. The claw 330 may extend substantially horizontally from the body 320. The claw may have a length of approximately 4.0 centimeters as measured from the body 320 to the tip of the hook 332.

The neck 340 may have a substantially cylindrical shape. The diameter of the neck 340 may be approximately 1.0 centimeter. The neck 340 is coupled to at least a first raised portion 342. The at least first raised portion 342 may be further coupled to the body 320.

Figure 3B:
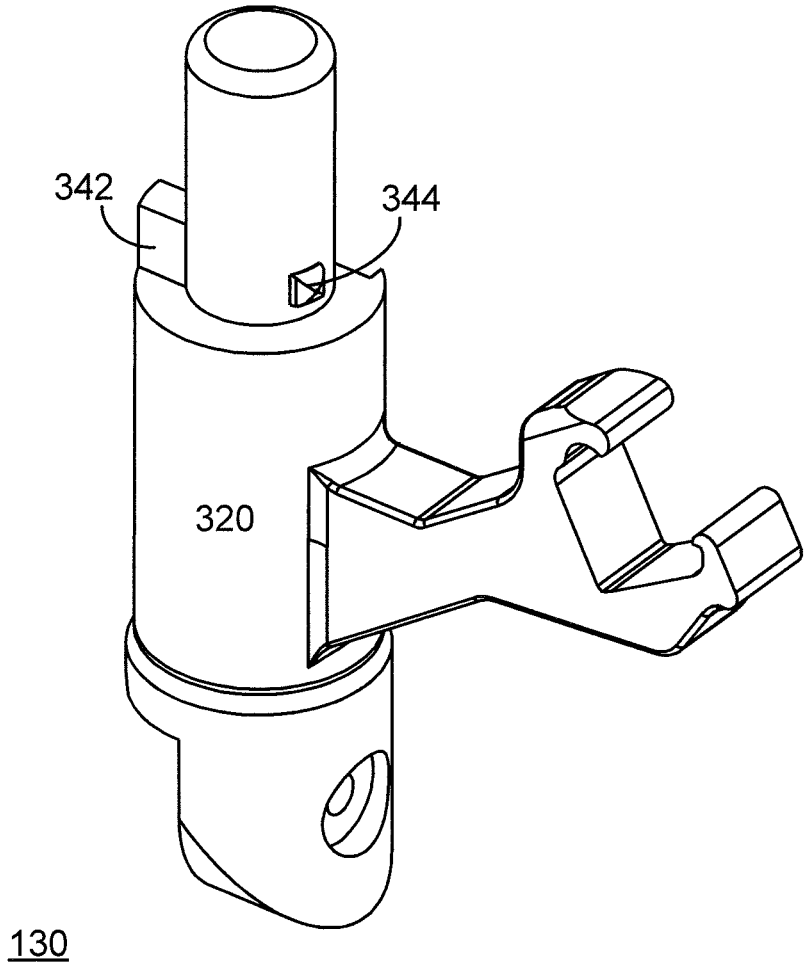
FIG. 3B is a second perspective view of an upper pivot joint.

FIG. 3B depicts a second perspective view of the upper pivot joint 130 shown in FIG. 3A. In addition to the first raised portion 342, the neck 340 may be coupled to a second raised portion 344. The first raised portion 342 may be substantially larger than the second raised portion 344. The first raised portion 342 and second raised portion 344 provide support to the reversible clip 140 when engaged to the upper pivot joint 130 in both the upward position and the downward position The support may be a pressure fitting and may prevent the reversible clip 140 from rotating about the upper pivot joint 130.

Figure 4A:
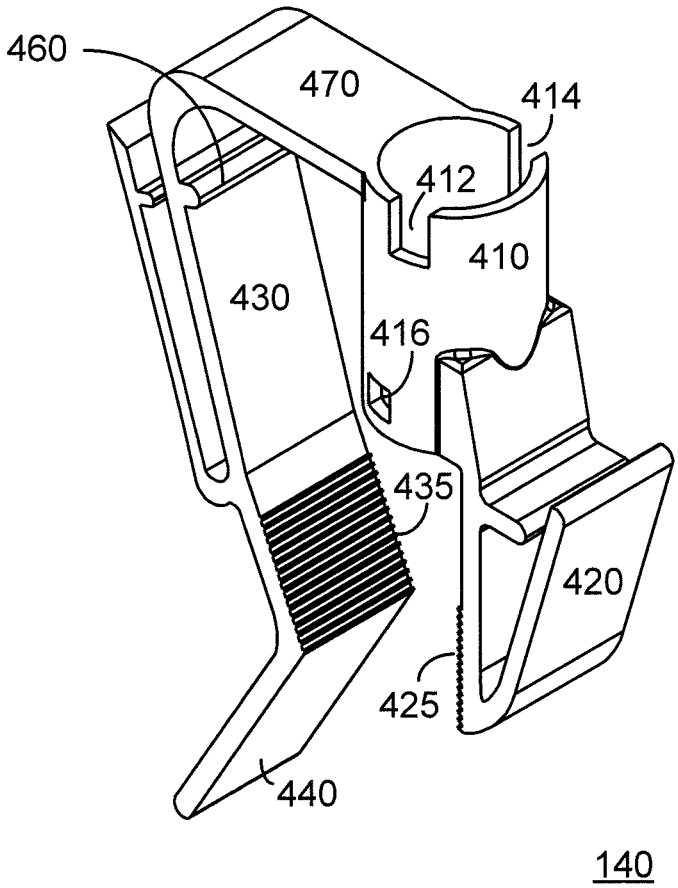
FIG. 4A is a first perspective view of a reversible clip in a downward position.

FIG. 4A depicts one embodiment of reversible clip 140. Reversible clip 140 comprises a base 410, a first clasp 420, a second clasp 430, a guide 440, a tab 460, and a horizontal member 470. The orientation of the reversible clip 140 is defined with respect to the direction of the clasp 420 and the clasp 430. If the clasp 420 and the clasp 430 are pointing upward with respect to the base 410, the clip is in an upward position. If the clasp 420 and the clasp 430 are pointing downward with respect to the base 410, the clip is in a downward position. As shown in FIG. 4A, the reversible clip 140 is oriented in a downward position.

The exterior surface of clasp 430 which faces the base 410 may comprise a plurality of teeth or grooves 435. Similarly, the exterior surface of clasp 420 which faces the base 410 may comprise a plurality of teeth or grooves 425.

The base 410 has a substantially cylindrical shape. The base 410 may have a length of approximately 2.2 centimeters, and a diameter of approximately 1.2 centimeters The horizontal member 470 is coupled to a first end of the base 410. The first end of the base 410 defines a first opening 412 and a second opening 414. The base 410 may further define a third opening 416 at or near the second end of the base 410.

Figure 4B:
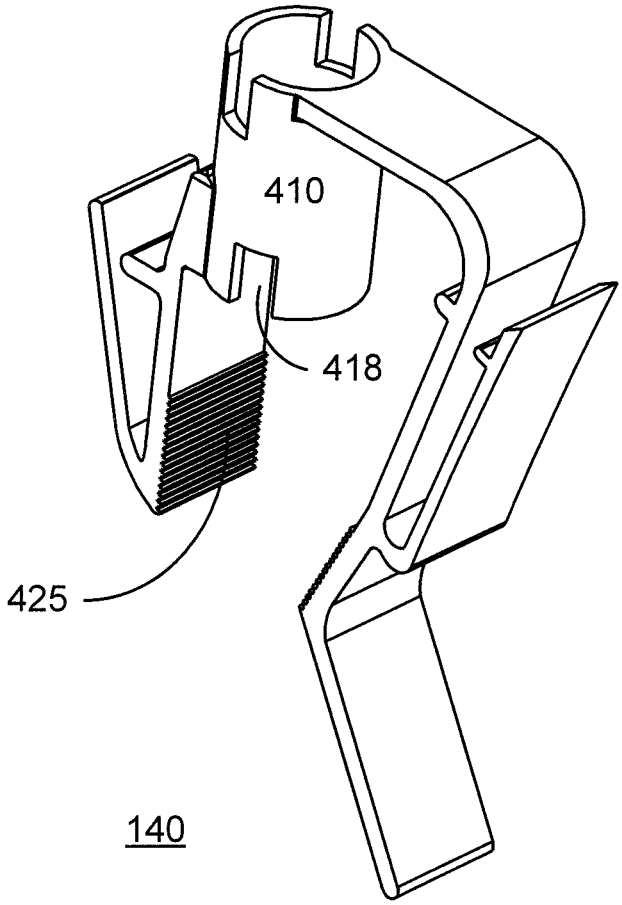
FIG. 4B is a first perspective view of a reversible clip in a downward position.

FIG. 4B depicts a second perspective view of the reversible clip 140 From this angle, it can be seen that base 410 defines at least a fourth opening 418 at the second end. The opening 418 may be greater than the opening 416.

The reversible clip 140 may be coupled to the upper pivot joint 130 in either the upward position or the downward position. The reversible clip 140 may be coupled to the upper pivot joint 130 with little or no rotation of the reversible clip 140 with respect to the upper pivot joint 130. The reversible clip 140 is shown coupled to the upper pivot joint 130 in the downward position in FIG. 1. If flipped about the horizontal axis, the reversible clip 140 of FIG. 1 would be coupled to the upper pivot joint 130 in the upward position.

The base 410 of the reversible clip 140 may slide over the neck 340 of upper pivot joint 130. When coupled in the upward position, raised portion 342 of upper pivot joint 130 may be aligned with opening 412 or opening 414 of reversible clip 140. Alternatively, when coupled in the downward position, raised portion 342 may be aligned with opening 418 and the inside edge of clasp 420 may be aligned with notch 324.

In the upward position, the reversible clip 140 may be coupled to a building structure, such as an eve. An exterior surface of clasp 420 and an exterior surface of clasp 430 may collectively form or define a third clasp. The distance between clasp 420 and clasp 430 may be between approximately 1.0 and 2.0 centimeters. The reversible clip 140 is comprised of a flexible material such as thermoplastic polymer such that the distance between clasp 420 and 430 may be increased to approximately 5.0 centimeters.

For one embodiment of the invention, the thermoplastic polymer may be polypropylene. The robust design of the reversible clip 140 and flexibility of the clamps allows the reversible clip 140 to be coupled to a variety of different building structure elements. For example, the reversible clip 140 may be coupled to building structure elements such as eves, rain gutters, and shingle siding.

Figure 5:
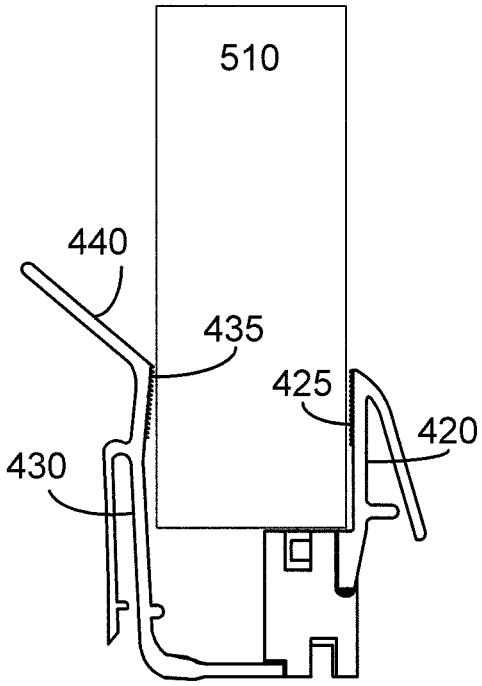
FIG. 5 is a section view of a reversible clip coupled to an eve of a building in accordance with an embodiment of the present invention.

FIG. 5 depicts a section view of a reversible clip 140 coupled to an eve 510 in accordance with an embodiment of the present invention. The reversible clip 140 may be attached to an eve 510 having a thickness of between approximately 1.0 and 5.0 centimeters. The guide 440 may be used to fit the third clasp around eve 510. The grooves 425 of clasp 420 and the grooves 435 of clasp 430 may improve grip or traction to the eve 510.

Figure 6:
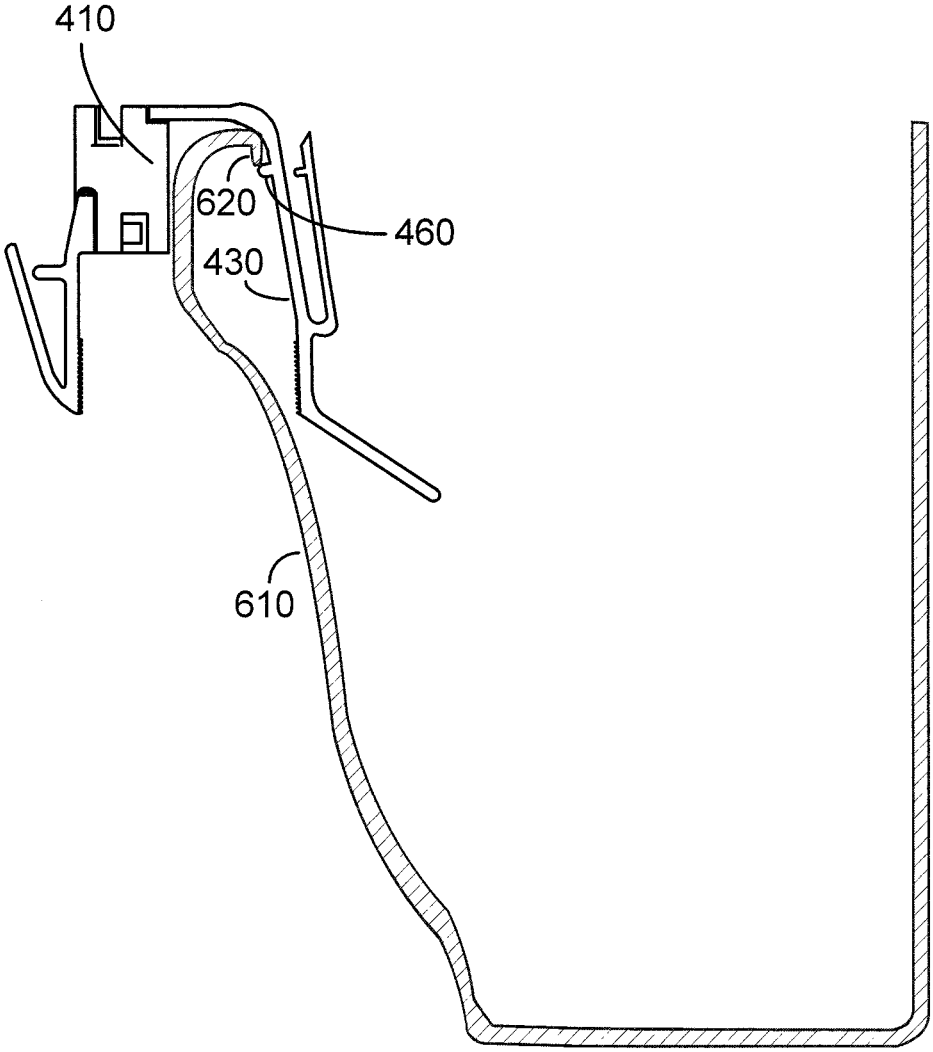
FIG. 6 is a section view of a reversible clip coupled to a rain gutter in accordance with an embodiment of the present invention.

In the downward position, the reversible clip 140 may be coupled to a rain gutter of a building. FIG. 6 depicts a section view of a reversible clip 140 coupled to a rain gutter in accordance with an embodiment of the present invention. A rain gutter typically comprises a body 610 and a lip 620. The reversible clip 140 may be coupled to the lip 620 of the gutter between the clasp 430 and base 410. The tab 460 may help secure the reversible clip 140 to the lip 620 of the gutter.

Clasps 420 and 430 may be used to couple the reversible clip 140 to elements of a building structure. The clasp 420 may be coupled to a building structure having a maximum thickness of 1.0 centimeter. The clasp 420 may have a tab 425 near the clasp opening to provide additional grip and tension. The clasp 430 may be coupled to a building structure having a maximum thickness of approximately 2.0 centimeters. The clasp 430 may have a tab 435 near the clasp opening to provide additional grip and tension.

Figure 7:
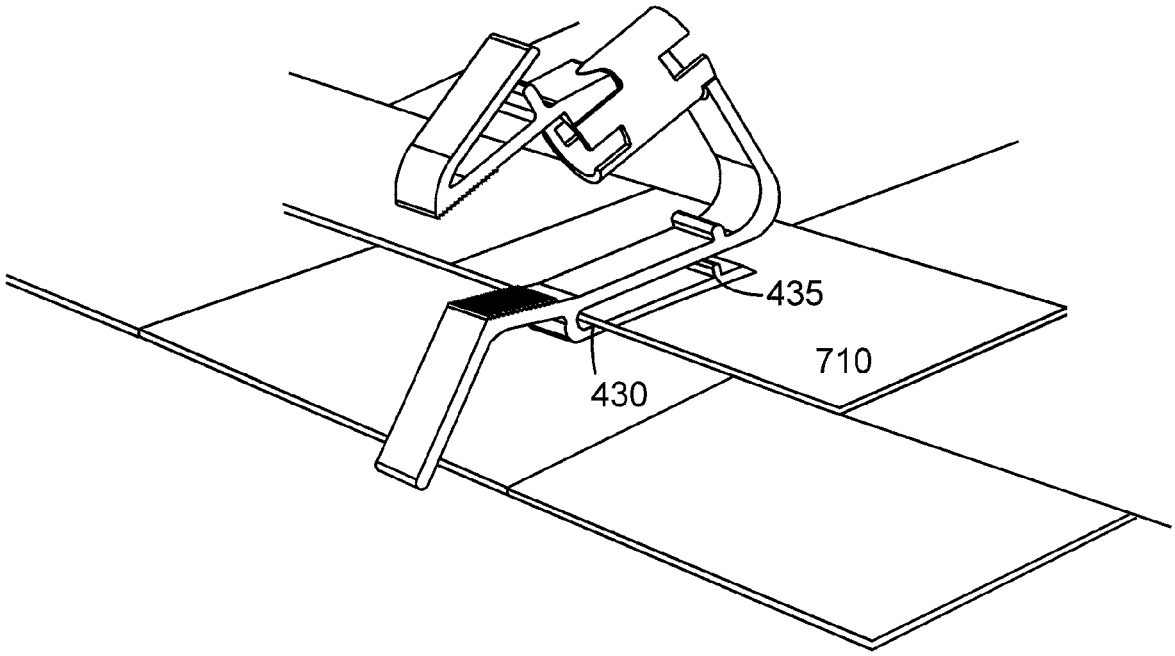
FIG. 7 is a perspective view of a reversible clip coupled to a shingle siding in accordance with an embodiment of the present invention.

FIG. 7 depicts a perspective view of a reversible clip 140 coupled to a shingle 710 in accordance with an embodiment of the present invention. The clasp 430 is coupled to the shingle 710. Tab 435 provides additional grip and tension to the underside of the shingle 710.

Figure 8:
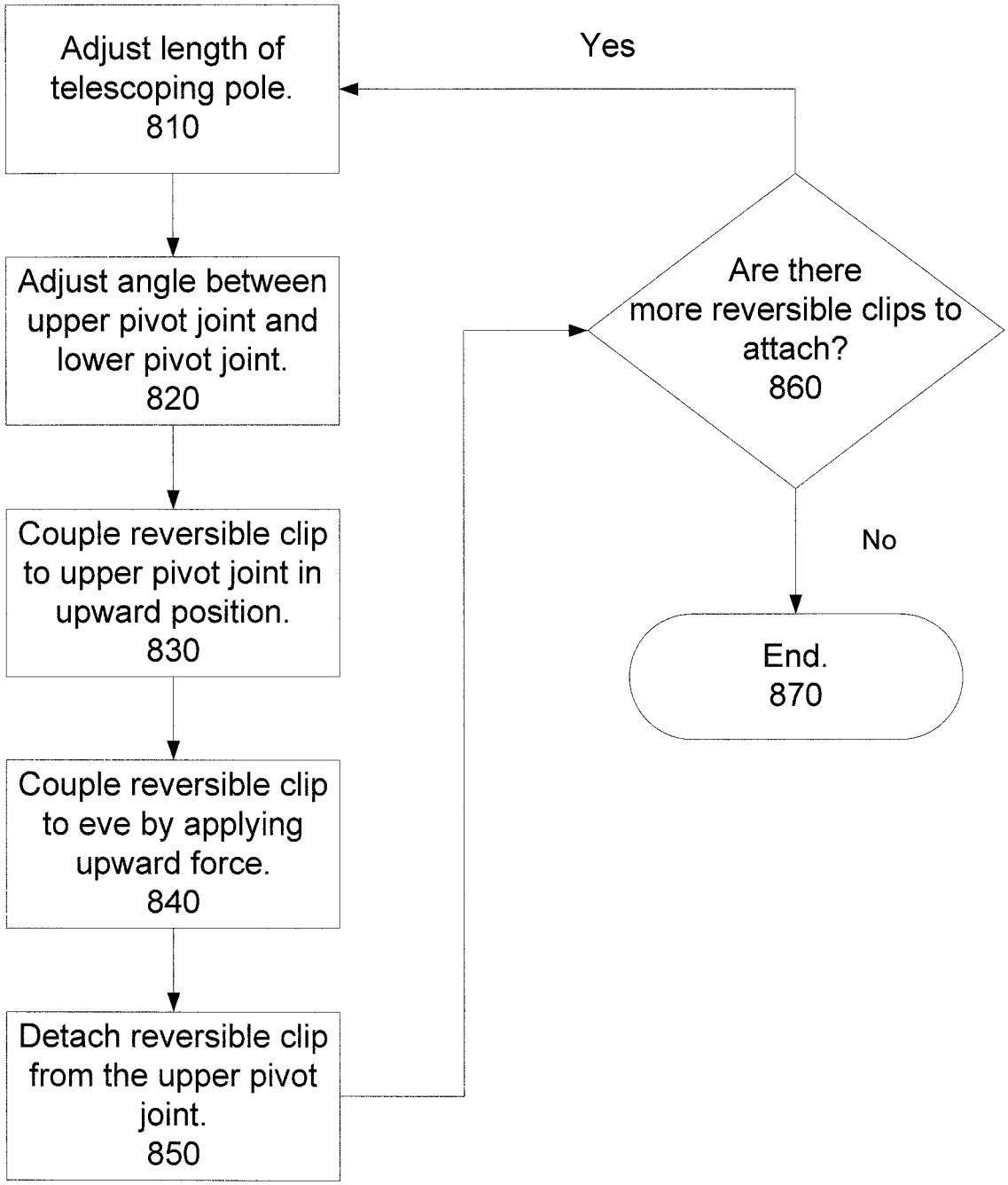
FIG. 8 is a flowchart of an embodiment of a process to attach a reversible clip to an eve of a building structure.

The reversible clip 140 may be coupled to building structures to hang objects such as lights. The reversible clip, however, may also be used to hang other items such as decorations or electrical wire. For one embodiment of the invention, FIG. 8 shows a flowchart for coupling the reversible clip 140 to an eve.

In operation 810, the length of the telescoping pole 110 may be adjusted in accordance with the height of the eve. The telescoping pole 110 may be adjusted to have a length of between approximately two and 24 feet. A lower pivot joint 120 is either part of the telescoping pole 110 or coupled to the telescoping pole 110. An upper pivot joint 130 is coupled to the lower pivot joint 120.

In operation 820 the angle between the upper pivot joint 130 and lower pivot joint 120 may be adjusted. The angle may be adjusted by rotating the upper pivot joint 130 with respect to the lower pivot joint 120. A fastener may be tightened to lock the desired angle once it is set. Further grooves 240 of lower pivot joint 120 and grooves 350 of upper pivot joint 130 may prevent movement between upper pivot joint 130 and lower pivot joint 120 once the angle is set.

In operation 830, the reversible clip 140 is removably coupled in an upward position to the upper pivot joint 130. The reversible clip 140 may be coupled to the upper pivot joint 130 without rotation of the reversible clip 140 with respect to the upper pivot joint 130 and/or the telescoping pole 110. At least one opening 412 of the reversible clip 140.may be coupled to at least a first raised portion 342. The angle between the telescoping pole 110 and reversible clip 140 may be altered at any time by loosening the fastener between upper pivot joint 130 and lower pivot joint 120 and making appropriate adjustments.

In operation 840, the reversible clip 140 may be positioned under an eve, or other building element, such that the opening of the reversible clip 140 as defined by the distance between clasp 420 and clasp 430 is aligned with the eve. The opening of the reversible clip 140 may be approximately less than or equal to the thickness of the eve. Once approximately aligned, a substantially vertical force in an upward direction may be applied to the telescoping pole 110 to couple the reversible clip 140 to the eve.

In operation 850, a substantially vertical force in a downward direction may be applied to the telescoping pole 110 to detach, or decouple, the reversible clip 140 from the upper pivot joint 130. The downward force may be approximately in the opposite direction as the force used to couple the reversible clip 140 to the eve. The minimum downward force to detach or decouple the reversible clip 140 from the upper pivot joint 130 may be approximately two foot-pounds. Rotation and/or twisting of the telescoping pole 110 or any other part is not required to remove the reversible clip 140 from the telescoping pole 110. In other words, the reversible clip 140 may be decoupled from the telescoping pole 110 with little or no rotation between the reversible clip 140 and the telescoping pole 110.

In operation 860, if there are more removable clips to attach, the process returns to operation 810. If there are no more removable clips to attach, the process terminates in operation 870. For this embodiment of the invention, lights and other objects may be coupled to the reversible clip 140 before or after coupling the reversible clip 140 to the eve. A string of lights may be coupled to the horizontal member 470, the clasp 420, or clasp 430.

Figure 9:
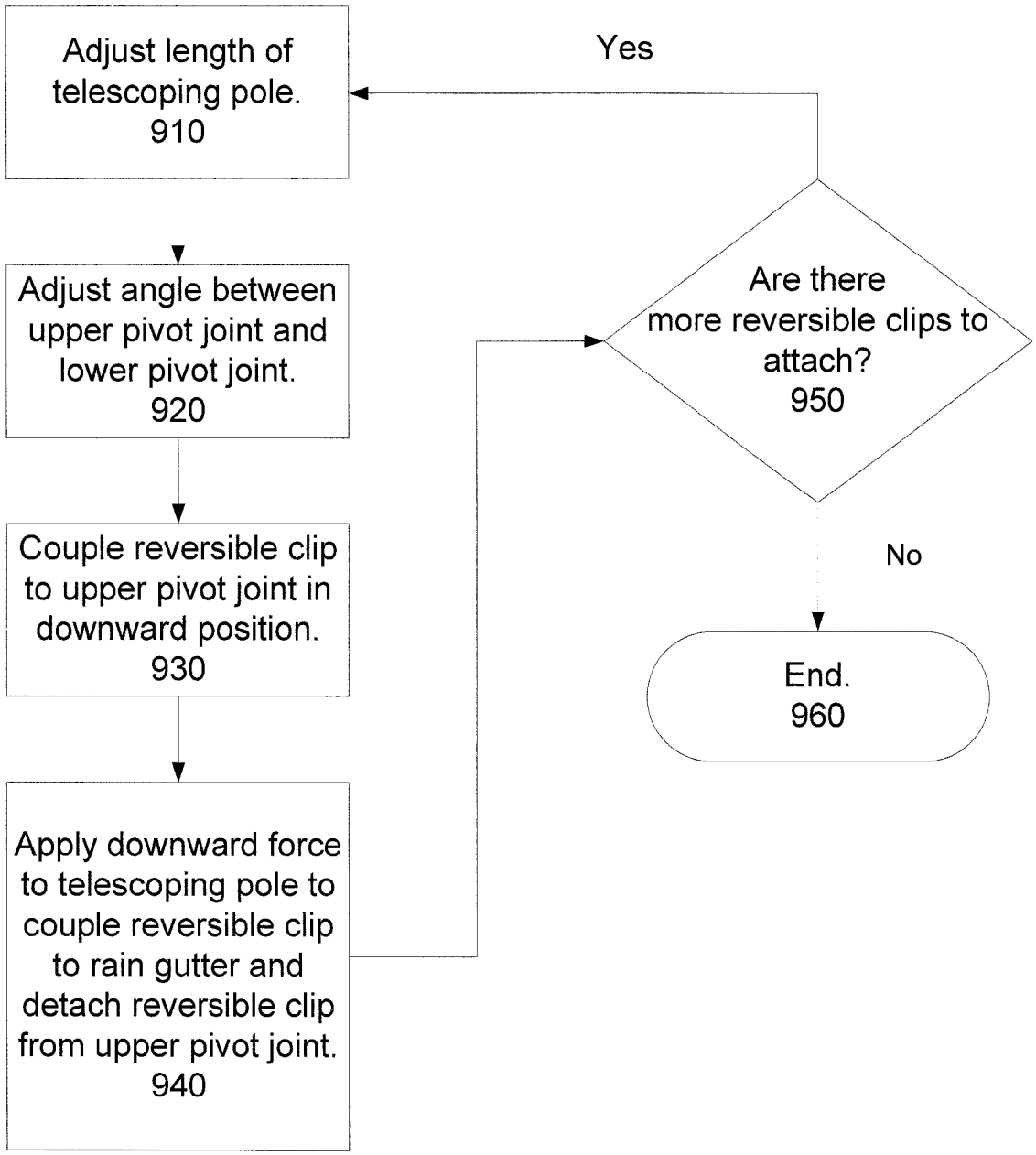
FIG. 9 is a flowchart of an embodiment of a process to attach a reversible clip to a rain gutter of a building structure.

For another embodiment of the invention, FIG. 9 shows a flowchart for coupling the reversible clip 140 to a rain gutter. Operations 910 and 920 are the same as operations 810 and 820 respectively, as described above. In operation 930, the reversible clip 140 is coupled in a downward position to the upper pivot joint 130. The reversible clip 140 may be coupled to the upper pivot joint 130 without rotation of the reversible clip 140 with respect to the upper pivot joint 130 and/or the telescoping pole 110. The inner edge of clasp 420 of the reversible clip 140 where teeth 425 are located may be aligned with the notch 324 of the upper pivot joint 130. When coupled, the teeth 425 along the clasp 420 may be in contact with notch 324, and raised portion 342 may be aligned with opening 418.

In operation 940, the reversible clip 140 is positioned over the lip of a rain gutter. The opening defined by the distance between the clasp 420 and the clasp 430 is aligned with the lip. With clasp 420 and base 410 positioned outside the lip and clasp 430 positioned inside the lip, a substantially vertical force in a downward direction is applied to the telescoping pole to couple the reversible clip to the rain gutter. The minimum downward force to detach or decouple the reversible clip 140 from the upper pivot joint 130 may be approximately two foot-pounds. As horizontal member 470 makes contact with the top of the rain gutter, reversible clip 140 is decoupled from the upper pivot joint 130. No rotation of the telescoping pole 110 is necessary to decouple the reversible clip 140 from the upper pivot joint 130.

In operation 950, if there are more removable clips to attach, the process returns to operation 910. If there are no more removable clips to attach, the process terminates in operation 960. For this embodiment of the invention, lights and other objects may be coupled to the reversible clip 140 before or after coupling the reversible clip 140 to the rain gutter. A string of lights may be coupled to the clasp 420.

Figure 10:
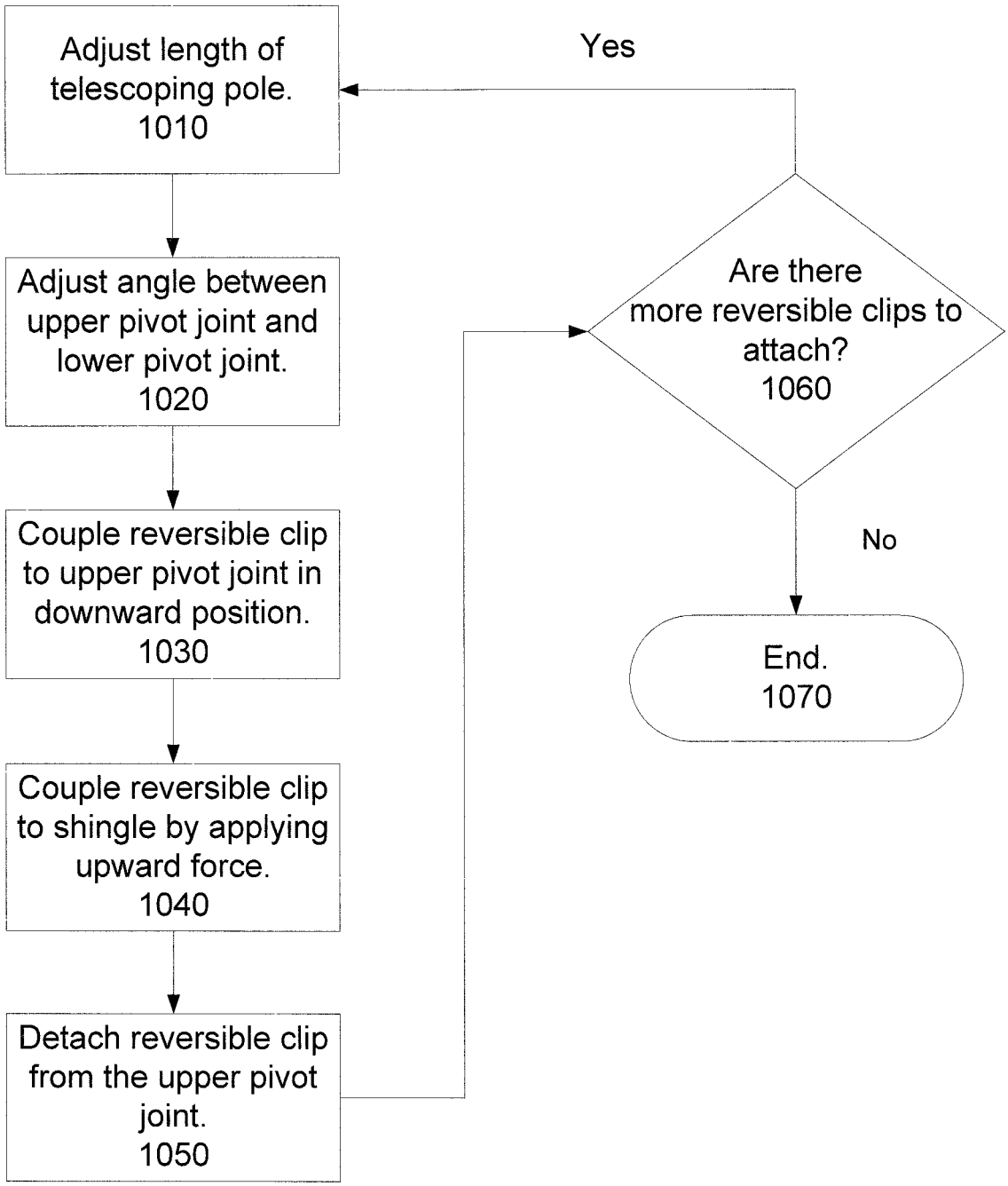
FIG. 10 is a flowchart of an embodiment of a process to attach a reversible clip to a shingle of a building structure.

For yet another embodiment of the invention, FIG. 10 shows a flowchart for coupling the reversible clip. 140 to a shingle. Operations 1010 and 1020 are the same as operations 810 and 820 respectively, as described above. Moreover, operation 1030 is the same as operation 930.

In operation 1040, the reversible clip 140 is positioned under a shingle siding. Tab 425 of clasp 420 or tab 435 of clasp 430 is approximately aligned with the bottom edge of the shingle. The clasp chosen may depend on the thickness of the shingle. A substantially vertical force in an upward direction may be applied to the telescoping pole to couple the clasp 420 or the clasp 420 of the reversible clip 140 to the shingle.

In operation 1050, a substantially vertical force in a downward direction may be applied to the telescoping pole 110 to detach the reversible clip 140 from the upper pivot joint 130. The downward force may be approximately in the opposite direction as the force used to couple the reversible clip 140 to the shingle. The minimum downward force to detach or decouple the reversible clip 140 from the upper pivot joint 130 may be approximately two foot-pounds. Rotation is not required to remove the reversible clip 140 from the telescoping pole 110. In other words, the reversible clip 140 may be decoupled from the telescoping pole 110 with little or no rotation between the reversible clip 140 and the telescoping pole 110.

In operation 1060, if there are more removable clips to attach, the process returns to operation 1010. If there are no more removable clips to attach, the process terminates in operation 1070. For this embodiment of the invention, if clasp 420 is coupled to the shingle, a string of lights and other objects may be coupled to clasp 430. Alternatively, if clasp 430 is coupled to the shingle, lights and other objects may be coupled to clasp 420.

Figure 11:
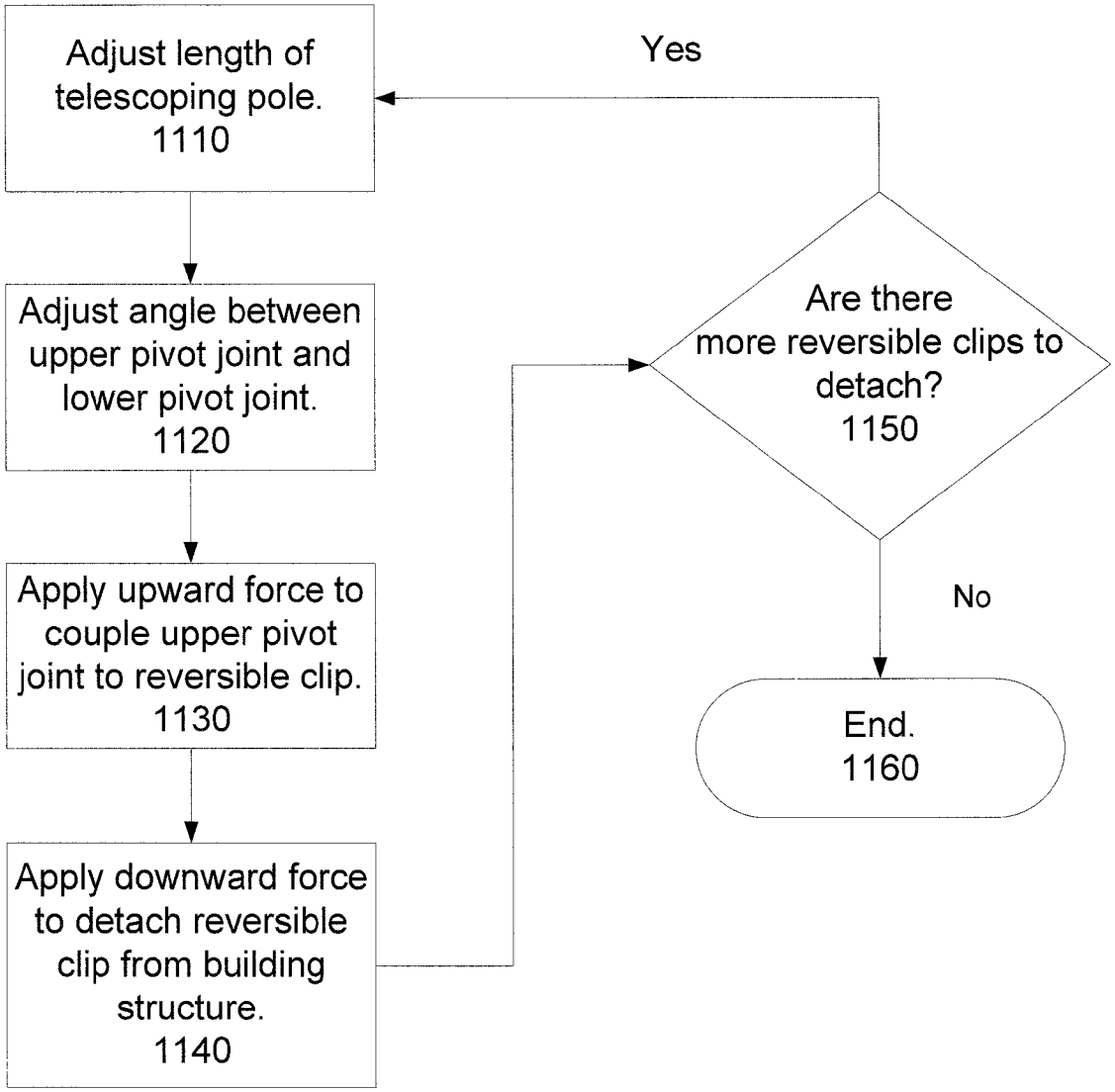
FIG. 11 is a flowchart of an embodiment of a process to detach a reversible clip in an upward position from a building structure.

The reversible clips 140 may be subsequently decoupled from building structures. For one embodiment of the invention, FIG. 11 shows a flowchart for decoupling the reversible clip 140 that is coupled to a building structure in an upward position.

In operation 1110, the length of the telescoping pole 110 may be adjusted in accordance with the height of the reversible clip 140. For example, the reversible clip 140 may be coupled to the eve of a building. The telescoping pole 110 may be adjusted to have a length of between approximately two and 24 feet.

In operation 1120 the angle between the upper pivot joint 130 and lower pivot joint 120 may be adjusted. The angle may be adjusted by rotating the upper pivot joint 130 with respect to the lower pivot joint 120. A fastener may be tightened to lock the desired angle once it is set. Further grooves 240 of lower pivot joint 120 and grooves 350 of upper pivot joint 130 may prevent movement between upper pivot joint 130 and lower pivot joint 120 once the angle is set.

In operation 1130, the upper pivot joint 130 may be positioned such that the neck 340 is aligned with the base 410 of the reversible clip 140. At least one opening 412 of the reversible clip 140 may be aligned to at least a first raised portion 342. A substantially vertical force in an upward direction may be applied to the telescoping pole 110 to couple the reversible clip 140 to the upper pivot joint 130. Rotation of the telescoping pole is not necessary to couple the upper pivot joint 130 to the reversible clip 140. In other words, the reversible clip 140 may be coupled to the upper pivot point 130 with little or no rotation between the reversible clip 140 and the upper pivot point 130.

In operation 1140, a substantially vertical force in a downward direction may be applied to the telescoping pole. The downward force may decouple the reversible clip from the building structure.

In operation 1150, if there are more removable clips to detach, the process returns to operation 1110. If there are no more removable clips to detach, the process terminates in operation 1160.

Figure 12:
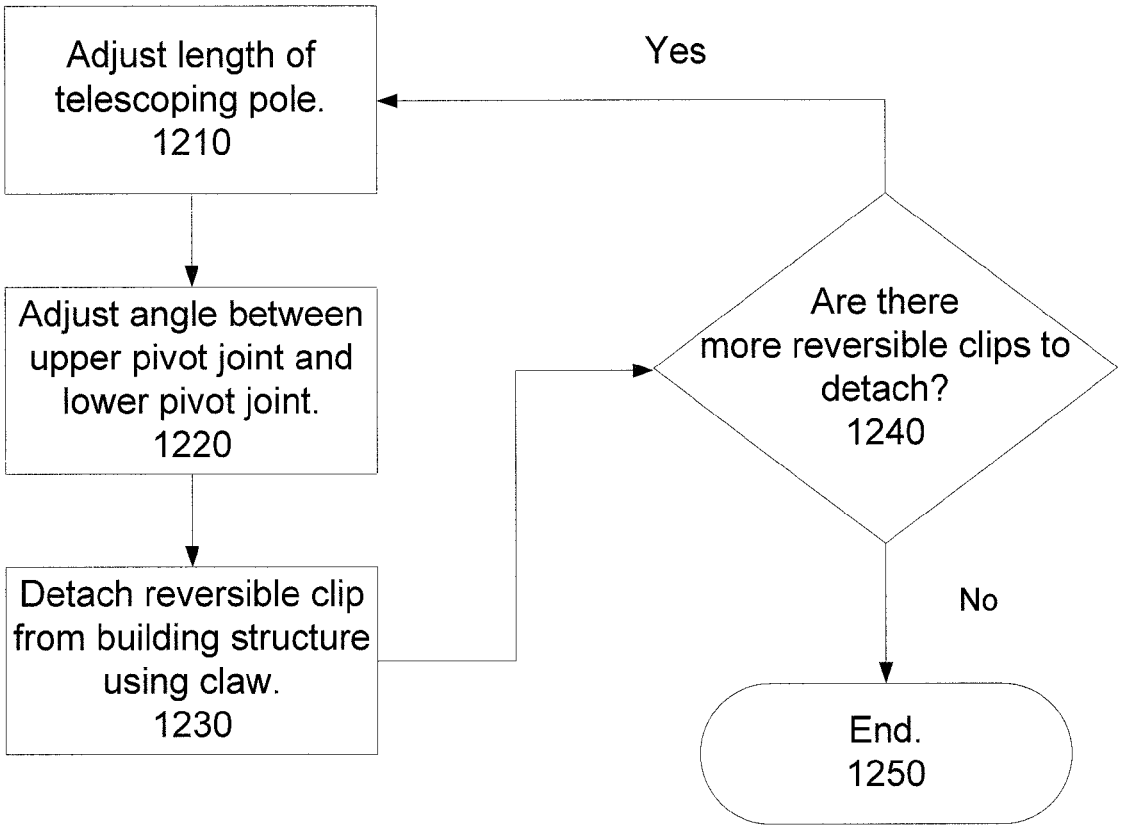
FIG. 12 is a flowchart of an embodiment of a process to detach a reversible clip in a downward position from a building structure.

For one embodiment of the invention, FIG. 12 shows a flowchart for decoupling the reversible clip 140 that is coupled to a building structure in a downward position. Operations 1210 and 1220 are the same as operations 1110 and 1120 respectively, as described above.

In operation 1230, the upper pivot joint 130 may be positioned such that the claw 330 is aligned with the base of the reversible clip. As described above, and depicted in FIGS. 1 and 3A, a claw 330 may be coupled to or integrated with telescoping pole 110. A substantially vertical force in an upward direction may be applied to the telescoping pole 110 to detach the reversible clip from the building structure with the claw 330.

In operation 1240, if there are more removable clips to detach, the process returns to operation 1210. If there are no more removable clips to detach, the process terminates in operation 1250.

In the forgoing specification, the invention has been described with reference to specific exemplary embodiments thereof. It will, however, be evident that various modification and changes may be made thereto without departure from the broader spirit and scope of the invention as set forth in the appended claims. The specification and drawings are, accordingly, to be regarded in an illustrative rather than restrictive sense.

What is claimed is:

1. An apparatus, comprising:

a telescoping pole having a first end and a second end;

a lower pivot joint having a first end and a second end, wherein the first end of the lower pivot joint is coupled to the first end of the telescoping pole;

an upper pivot joint having a first end and a second end, the first end of the upper pivot joint is coupled to the second end of the lower pivot joint, wherein an angle formed by the first end of the upper pivot joint and the second end of the lower pivot joint is adjustable, and the second end of the upper pivot joint comprises a male end configured to be couplable to a female end of a clip without rotating the apparatus;

wherein the clip is configured to be removably coupled to one of a first building structure and a second building structure; and wherein the second end of the upper pivot joint is configured to be couplable to a first female end of the clip and a second female end of the clip.

2. The apparatus of claim 1, wherein the first female end of the clip is flipped upside down with respect to the second female end of the clip.

3. An apparatus, comprising:

a telescoping pole having a first end and a second end;

a lower pivot joint having a first end and a second end, wherein the first end of the lower pivot joint is coupled to the first end of the telescoping pole;

an upper pivot joint having a first end and a second end, the first end of the upper pivot joint is coupled to the second end of the lower pivot joint, wherein an angle formed by the first end of the upper pivot joint and the second end of the lower pivot joint is adjustable, and the second end of the upper pivot joint comprises a male end configured to be couplable to a female end of a clip without rotating the apparatus;

wherein the clip is configured to be removably coupled to one of a first building structure and a second building structure; and wherein the upper pivot joint comprises at least one raised portion, the clip comprises at least one opening, and the at least one raised portion is configured to be couplable to the at least one opening of the clip.

* * * * *

UNITED STATES PATENT AND TRADEMARK OFFICE

CERTIFICATE OF CORRECTION

PATENT NO. : 8,459,712 B2
APPLICATION NO. : 12/398399
DATED : June 11, 2013
INVENTOR(S) : Charles T. Thrasher, Jr. et al.

It is certified that error appears in the above-identified patent and that said Letters Patent is hereby corrected as shown below:

Title Page

Item (12)
Change "Thrasher et al." to --Thrasher, Jr. et al.--.

Item (75)
Change "Charles T Thrasher" to --Charles T. Thrasher, Jr.--.

Signed and Sealed this
Twenty-fourth Day of September, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,459,712 B2
APPLICATION NO. : 12/398399
DATED : June 11, 2013
INVENTOR(S) : Thrasher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 345 days.

Signed and Sealed this
Thirtieth Day of December, 2014

Michelle K. Lee

Michelle K. Lee
*Deputy Director of the United States Patent and Trademark Office*